US009663897B2

(12) United States Patent
Vesala et al.

(10) Patent No.: US 9,663,897 B2
(45) Date of Patent: May 30, 2017

(54) METHOD OF AND AN ARRANGEMENT FOR INTRODUCING PROCESS LIQUID FROM A TREATMENT STEP TO A WASHING AND/OR FILTERING APPARATUS

(71) Applicant: Sulzer Management AG, Winterthur (CH)

(72) Inventors: Reijo Vesala, Kotka (FI); Vesa Vikman, Kotka (FI)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 14/899,961

(22) PCT Filed: Jun. 16, 2015

(86) PCT No.: PCT/EP2015/063420

§ 371 (c)(1),
(2) Date: Dec. 18, 2015

(87) PCT Pub. No.: WO2016/000948

PCT Pub. Date: Jan. 7, 2016

(65) Prior Publication Data

US 2016/0215450 A1 Jul. 28, 2016

(30) Foreign Application Priority Data

Jul. 1, 2014 (EP) ..... 14175251

(51) Int. Cl.
*D21C 9/02* (2006.01)
*D21C 9/06* (2006.01)
(Continued)

(52) U.S. Cl.
CPC ..... *D21C 9/02* (2013.01); *D21C 7/08* (2013.01); *D21C 9/06* (2013.01); *D21C 9/18* (2013.01)

(58) Field of Classification Search
CPC ... D21C 7/08; D21C 9/02; D21C 9/10; D21C 9/18; D21C 11/0028; D21C 9/00;
(Continued)

(56) References Cited

U.S. PATENT DOCUMENTS 2,685,937 A * 8/1954 Clark ..... D21D 5/26 137/411
4,975,204 A * 12/1990 Henricson ..... D21C 9/18 162/380
(Continued)

FOREIGN PATENT DOCUMENTS

FI EP 0298499 A1 * 1/1989 ..... D21C 9/18
FI WO 9100768 A1 * 1/1991 ..... B01D 33/09
(Continued)

OTHER PUBLICATIONS

International Search Report and Written Opinion issued Aug. 17, 2015 in PCT/EP2015/063420, Filed Jun. 16, 2015.

*Primary Examiner* — Jose Fortuna
(74) *Attorney, Agent, or Firm* — Global IP Counselors, LLP

(57) ABSTRACT

A method of and an arrangement for introducing fiber suspension or pulp from a pulp vessel to a washing and/or filtering apparatus is based on simultaneous division and degassing of pulp at immediately upstream of the washing and/or filtering apparatus.

16 Claims, 4 Drawing Sheets

(51) Int. Cl.
*D21C 7/08* (2006.01)
*D21C 9/18* (2006.01)

(58) Field of Classification Search
CPC .. D21C 9/007; D21C 9/04; D21C 9/06; D21F 1/06; F04D 7/045; F05B 2210/132; D21D 5/28; D21D 5/26
See application file for complete search history.

(56) References Cited

U.S. PATENT DOCUMENTS 5,106,456 A * 4/1992 Voitto ..... D21D 5/28 162/17
5,141,535 A * 8/1992 Elonen ..... F04D 7/045 415/169.1
5,219,472 A * 6/1993 Elonen ..... D21D 5/26 162/28
5,538,597 A * 7/1996 Koso ..... D21C 7/08 137/238
5,876,561 A 3/1999 Tsai
6,120,252 A * 9/2000 Reponen ..... F04D 7/045 415/143
6,193,406 B1 * 2/2001 Peltonen ..... B01F 7/00908 366/168.2
6,958,109 B1 * 10/2005 Heikkila ..... D21C 7/08 162/246
9,163,358 B2 * 10/2015 Kettunen ..... D21C 9/04
9,339,777 B2 * 5/2016 Vesala ..... B01F 7/00175
9,416,491 B2 * 8/2016 Vesala ..... D21C 7/08
2001/0006484 A1 * 7/2001 Peltonen ..... B01F 7/00908 366/168.2
2014/0190643 A1 * 7/2014 Vesala ..... D21C 7/08 162/49
2016/0215450 A1 * 7/2016 Vesala ..... D21C 9/06
2016/0319484 A1 * 11/2016 Vesala ..... D21F 1/06

FOREIGN PATENT DOCUMENTS

FI EP 0440455 A1 * 8/1991 ..... B01D 19/0052
FI WO 2009037091 A1 * 3/2009 ..... D21C 7/08
WO 8404114 A1 10/1984
WO 9301875 A1 2/1993

* cited by examiner

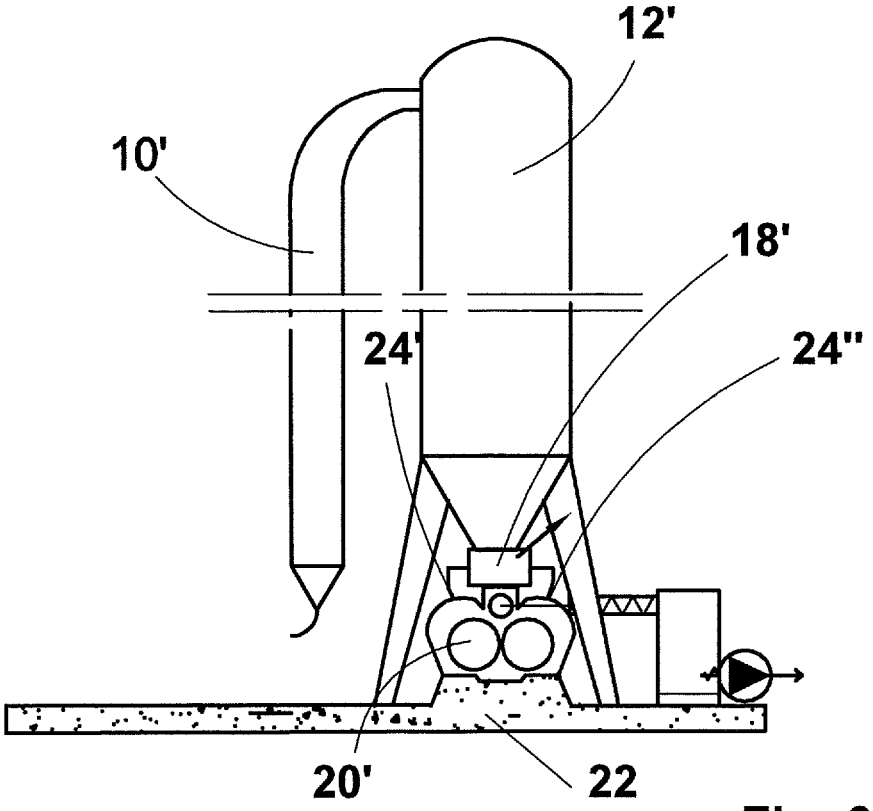
Fig. 6
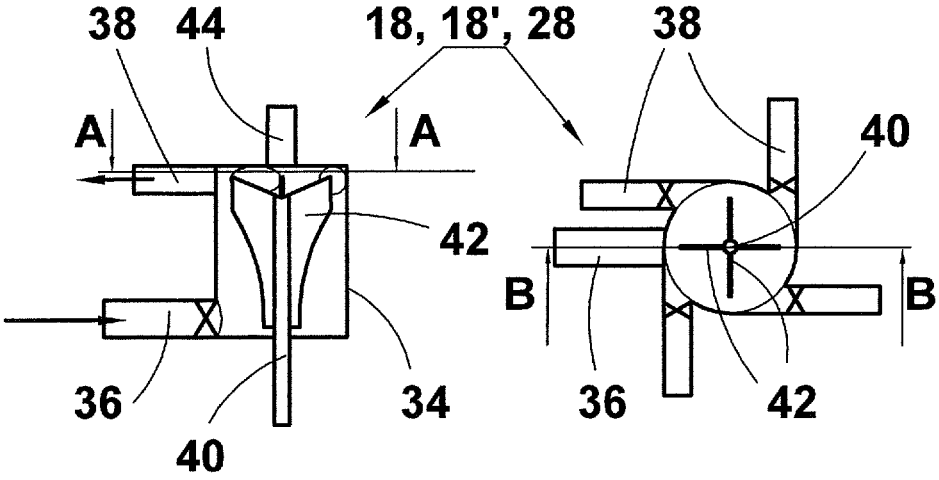
Fig. 7A
Fig. 7B

METHOD OF AND AN ARRANGEMENT FOR INTRODUCING PROCESS LIQUID FROM A TREATMENT STEP TO A WASHING AND/OR FILTERING APPARATUS

CROSS-REFERENCE APPLICATION

This application is a U.S. National Stage Application of International Application No. PCT/EP2015/063420, filed Jun. 16, 2015, which claims priority to European Application No. 14175251.9, filed Jul. 1, 2014, the contents of each of which is hereby incorporated herein by reference.

FIELD OF INVENTION

The present invention relates to a method of and an arrangement for introducing a process liquid from a treatment step to a washing or filtering apparatus. The present invention is especially applicable for introducing pulp or fiber suspension from a storage tower or reaction vessel to a washing or filtering apparatus in pulp and paper making industry.

BACKGROUND INFORMATION

Examples of prior art methods and arrangements for introducing fiber suspensions or pulps from a pulp storage tower or reaction vessel to a washing or filtering equipment will be discussed in the following.

A good example of the problem areas in pulp and paper industry are various washing, filtering and/or thickening stages, or washing, filtering and/or thickening means between the digestion of wood chips in chemical pulping or other wood treatment in mechanical and chemi-mechanical pulping and the web formation at a pulp or paper mill. Such means are needed, for instance in so called brown stock washing and in various washing stages when delignifying and bleaching the pulp. In pulp and paper making industry various different washing, filtering or thickening means are used. Due to the wide variety of the equipment the requirements the apparatus sets for the pulp or fiber suspension are variable, too. For instance, the inlet consistency percentage of such apparatus varies from about 5 up to about 12.

However, the apparatus, or rather the process has one requirement that is valid irrespective of the consistency of the fiber suspension, i.e. the gas or air content of the fiber suspension or pulp should always be as low as possible, as the more gas the pulp contains the more gas enters the filtrate, and the more foam tends to form in the filtrate when treating the filtrate impeding the pumping and other treatment of the filtrate. However, a fact is that the amount of gas in the pulp or fiber suspension increase when the consistency increases. Thereby the problems the gas causes are increased lately as the consistency of the pulp to be treated has been raised for reducing the water consumption. In other words, the gas content of the fiber suspension has simultaneously increased.

Another requirement the various washing, filtering and/or thickening apparatus has, is a uniform feed of fiber suspension to the washing, filtering and/or thickening apparatus. Usually the washing, filtering and/or thickening apparatus have such a wide working width that the fiber suspension is introduced in the apparatus via more than one inlet, whereby the flow in the several inlets should be as equal and uniform as possible. In other words, the volume flows via the inlets should be equal. This is not an easy task as one has to use a flow divider, which is most often a static device having one inlet and as many outlets as required. The outlets are normally provided with valves for controlling the volume flow of pulp via the outlets. Due to its nature such a flow divider works the more reliably the lower the consistency is and vice versa. For the above reason prior art knows flow dividers that are provided with a rotor for facilitating the division of thick fiber suspension to the outlets.

A third requirement the washing, filtering and/or thickening apparatus has, is a certain apparatus-specific optimal inlet pressure. In other words, each apparatus is designed for a certain inlet pressure to ensure that the division of pulp or fiber suspension on the filtering surfaces of the apparatus results in a layer of pulp having optimal properties in view of the operations the apparatus is designed for, i.e. washing or filtering.

SUMMARY

Thus, an object of the present invention is to develop a novel method of and an arrangement for introducing process liquid from a treatment step to a washing or filtering apparatus such that at least one of the above mentioned and/or other problems is solved.

Another object of the present invention is to develop a novel method of and an arrangement for introducing process liquid from a treatment step to a washing or filtering apparatus such that gas may be separated from the fiber suspension or pulp as efficiently as possible.

Yet another object of the present invention is to develop a novel method of and an arrangement for introducing process liquid from a treatment step to a washing or filtering apparatus such that the inlet pressure of the fiber suspension or pulp to the washing or filtering apparatus is the desired one.

A further object of the present invention is to develop a novel method of and an arrangement for introducing process liquid from a treatment step to a washing or filtering apparatus such that the division of pulp or fiber suspension is performed as reliably as possible.

A still further object of the present invention is to develop a novel method of and an arrangement for introducing process liquid from a treatment step to a washing or filtering apparatus such that the number of equipment in the blow line of the pulp vessel is minimized.

In order to solve, at least one of the prior art problems, the method of introducing process liquid from a treatment step to a washing or filtering apparatus comprising at least one inlet for receiving the fiber suspension or pulp comprises the steps of:

a) discharging pulp from the treatment step to a gas separator, b) separating gas from the pulp, and c) introducing the pulp to the washing or filtering apparatus, d) performing step b) at the level of the at least one inlet, and e) controlling the feed pressure of the washing or filtering apparatus by a means or device arranged in connection with the gas separator.

For the same purpose the arrangement for introducing a process liquid from a treatment step to a washing or filtering apparatus, the arrangement comprising a treatment step from which the process liquid is discharged to a gas separation and taken therefrom to a washing and/or filtering apparatus having at least one inlet, wherein that the gas separation is performed by a gas separator arranged at the level of the at least one inlet and include a device or means for controlling the feed pressure of the washing or filtering apparatus.

Other characteristic features of the method and the arrangement of the present invention are disclosed in herein.

The advantages gained by the arrangement of the present invention are as follows:

The number of equipment needed in transferring pulp to the washing and/or filtering apparatus and removing gas from the pulp is minimized, which also means minimal consumption of energy. In the most energy efficient arrangement there is not a single pump needed in the pulp transfer line between the pulp vessel and the washing and/or filtering apparatus.

The pipeline between the pulp vessel and the washing and/or filtering apparatus is as short as possible for minimized pressure losses.

The pressure of the pulp in the downflow vessel or the level of pulp in the downflow vessel ensures steady, even and reliable flow of pulp to the washing and/or filtering apparatus. The washing and/or filtering apparatus is positioned as low as possible so that the level of the pulp upstream of the washing and/or filtering apparatus may be utilized, if desired, in full.

The downflow vessel as well as the entire transfer line from the preceding treatment step to the washing and/or filtering apparatus is either downward flowing or substantially horizontal, which ensures pulp flow to the washing and/or filtering apparatus in all running levels of the preceding vessel. In other words, pulp may flow vertically upwards only in such a case that the internal operation of the dividing/degassing apparatus precludes such.

The gas may be separated efficiently from the pulp upstream of the washing and/or filtering apparatus (improves the efficiency and capacity of the washing and/or filtering apparatus and ensures steady and even flow to the washing and/or filtering apparatus). The separation of gas takes place in the zone of lowest pressure upstream of the washing and/or filtering apparatus thereby ensuring most efficient gas separation.

The separation of gas is performed by a device that may be capable of creating in the pulp several pressure levels for separating gas. There are various different structural alternatives for the gas separator. It may be like a gas separating centrifugal device having several pressure outlets, like an MC-discharger having gas separation and several outlets, a screw conveyer having a centrifugally operating section, an apparatus like a bottom scraper, i.e. any rotating device capable of creating a zone or zones of lower pressure for collecting gas.

BRIEF DESCRIPTION OF THE DRAWINGS

The invention will be explained in more detail hereinafter with reference to the drawings.

FIG. 6 illustrates a novel arrangement for introducing pulp from a pulp vessel to a washing, filtering and/or thickening apparatus in accordance with a fourth preferred embodiment of the present invention;

FIGS. 7A and 7B illustrate an apparatus for both dividing and degassing the pulp from in the blow line of a pulp vessel upstream of the washing, filtering and/or thickening apparatus.

DETAILED DESCRIPTION OF THE EMBODIMENTS

Figure 1:
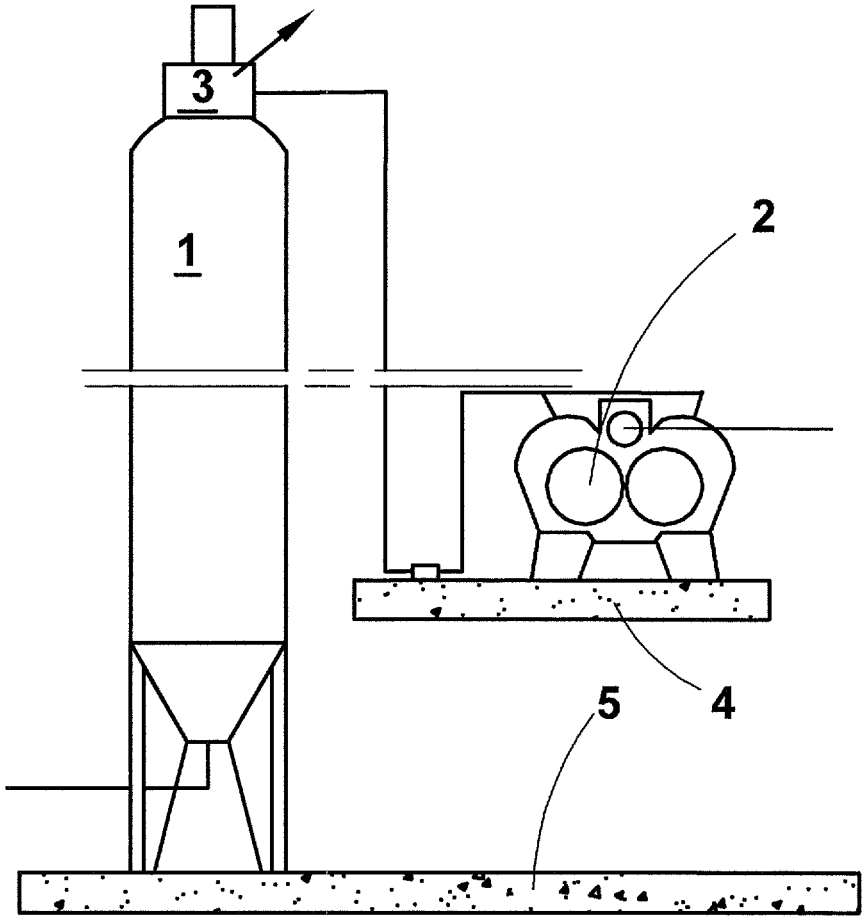
Fig. 1 (Prior art)
FIG. 1 illustrates a prior art arrangement for transferring pulp from a pulp vessel to a washing, filtering and/or thickening apparatus.

FIG. 1 illustrates as an example of prior art arrangements for transferring a process liquid from a treatment step to a washing apparatus a pulp vessel of a bleaching sequence at a pulp mill where pulp is discharged from an upflow bleaching tower 1 or reactor and taken via a downflow pipe to a washing and/or filtering apparatus 2 (twin roll wash press shown as an example). Other washing devices that may utilize the present invention are a single roll wash press, and a DrumDisplacer™ washing and/or filtering apparatus, just to name a few alternatives without any intention to limit the use of the invention to these examples only. The discharge of pulp from the upflow reactor 1 to the washing and/or filtering apparatus 2 takes place, in this example, by a top discharger 3 that is capable of separating gas from the pulp. The washing and/or filtering apparatus 2 is in this optional layout arranged by legs or some other appropriate means or device on a floor level 4 which is arranged one or more stories above the bottom level 5 on which the reactor or pulp vessel 1 is supported.

Figure 2:
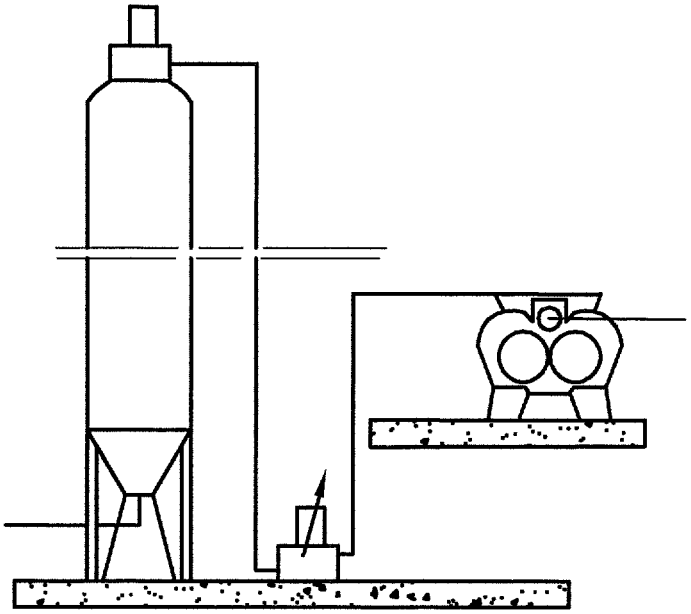
Fig. 2 (Prior art)
FIG. 2 illustrates another prior art arrangement for transferring pulp from a pulp vessel to a washing, filtering and/or thickening apparatus.

In another optional prior art layout illustrated in FIG. 2 an ordinary top discharger (i.e. normally without the gas separation) is arranged at the top of the reactor such that it moves the pulp from the reactor, i.e. from the upflow vessel, to a downflow pipe, more generally called as downflow vessel, at the bottom of which, i.e. at the level of the bottom floor where the upflow vessel is standing, a gas separator separates gas from the pulp. The intention of the gas separation is to remove gas from the fiber suspension such that the gas does not interfere the washing of pulp and/or cause foaming of the washing and/or filtering apparatus filtrates. The gas separator supplies the pulp, possibly by a pump, to a washing and/or filtering apparatus, now arranged up to such a level that the discharge of both the washed fiber suspension and the filtrate from the washing and/or filtering apparatus may be performed to a drop leg or barometric leg for pumping the fiber suspension and the filtrate further in the process. The gas separator arranged on a lower level than the washing apparatus may be capable of raising pressure, if the hydrostatic pressure of the downflow vessel is lost in the gas separation to such an extent that the remaining pressure difference is not capable of making the fiber suspension flow in the washing apparatus. Anyway, as the gas separation is arranged at a lower level than the washing apparatus and as the washing apparatus requires quite a low feed pressure for pulp, the pressure of the pulp entering the washing and/or filtering apparatus is significantly lower than that of the pulp entering the gas separation. Thereby the gas separation is not capable of separating gas such that there would be no gas in the pulp entering the washing and/or filtering apparatus but some gas remains in the pulp, which due to lower pressure conditions is capable of separating from the liquid phase and causes foaming of the filtrate.

Figure 3:
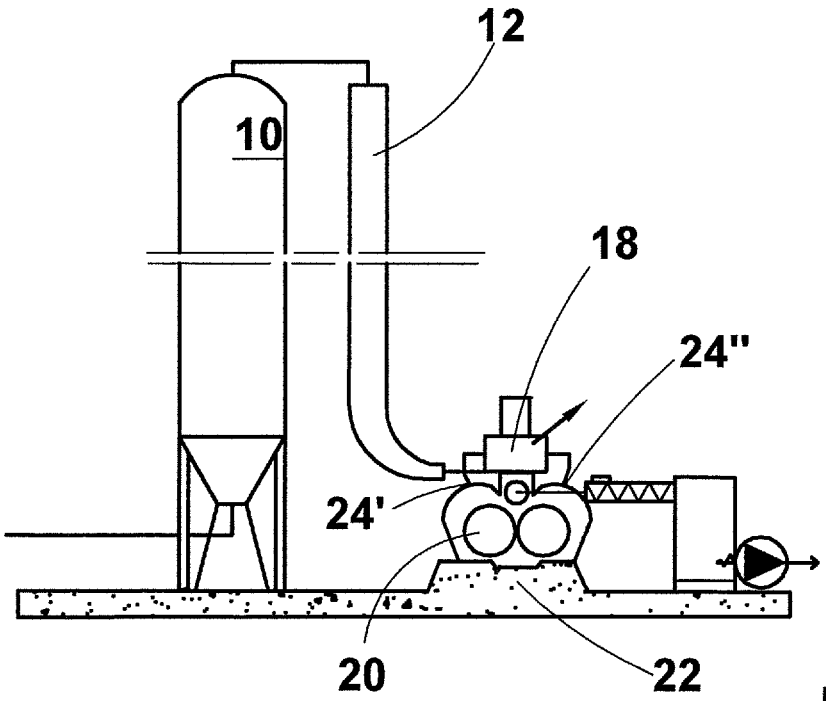
FIG. 3 illustrates a novel arrangement for introducing pulp from a pulp vessel to a washing, filtering and/or thickening apparatus in accordance with a first preferred embodiment of the present invention.

FIG. 3 illustrates an arrangement for introducing pulp (more generally, process liquid) from a storage tower or a reactor or some other corresponding upflow pulp vessel (more generally, from a treatment step) to a washing and/or filtering apparatus in accordance with a first preferred embodiment of the present invention. In the arrangement shown in FIG. 3 the washing and/or filtering apparatus 20 is arranged on a support structure 22 of its own, including but not limited to separate legs or some kind of platform on the bottom floor on which the upflow pulp vessel is standing, at a side of the upflow pulp vessel 10 such that the pulp may be discharged from the top of the upflow vessel 10, possibly assisted by an ordinary top discharger (not shown), to a downflow pipe 12 (in broader terms a downflow vessel), which introduces the pulp at a consistency of at least 5%, normally between 7 and 12%, to the inlet level of the washing and/or filtering apparatus 20 or slightly thereabove. By the inlet level is understood substantially the horizontal level in which the inlet ducts or inlets 24', 24" to the washing and/or filtering apparatus 20 are located. The washing and/or filtering apparatus 20 includes, in this embodiment of the present invention, a gas separator 18 that is integrated with the washing and/or filtering apparatus 20 such that the gas separator 18 is structurally supported by the washing and/or filtering apparatus 20. Another preferred feature of the gas separator 18 is that the separator 18 not only separates gas from the process liquid but also divides the process liquid evenly to the inlets 24' and 24" (two inlets shown as an example only) of the washing and/or filtering apparatus 20. A further preferred feature of the gas separator/flow divider 18 is that, in connection with the gas separator/flow divider 18, there is a device of means for controlling the inlet pressure of the washing and/or filtering apparatus 20. Such means may be a constant or fixed throttling or an adjustable valve arranged in the inlet to the gas separator/flow divider 18 or in the outlets thereof, as exemplarily shown in FIGS. 7*a* and 7*b*.

Figure 4:
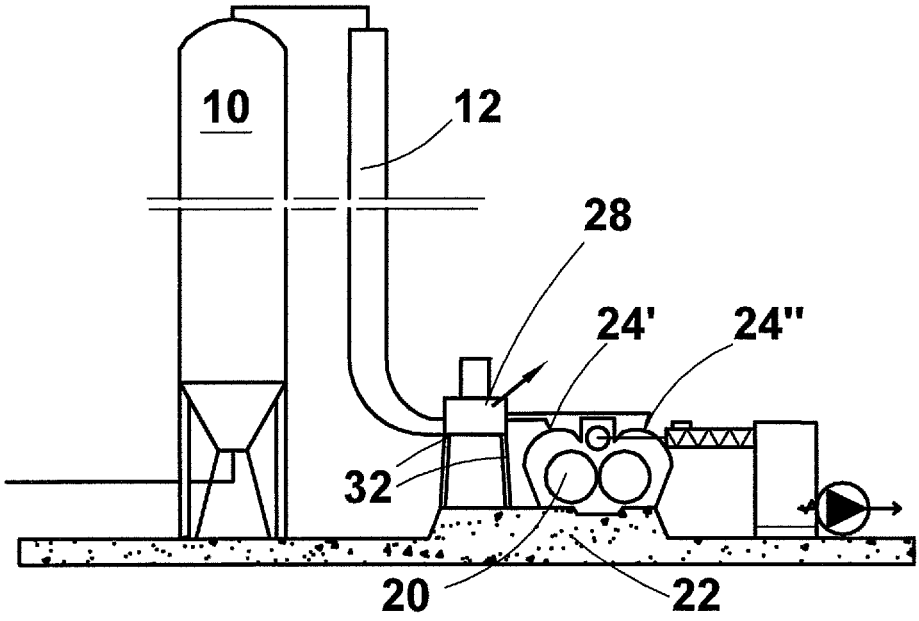
FIG. 4 illustrates a novel arrangement for introducing pulp from a pulp vessel to a washing, filtering and/or thickening apparatus in accordance with a second preferred embodiment of the present invention.

FIG. 4 illustrates an arrangement for introducing pulp (more generally, a process liquid) from a treatment step (here a storage tower or a reactor or some other corresponding upflow vessel) via a downflow vessel 12 at a consistency of at least 5%, normally between 7 and 12%, to a washing and/or filtering apparatus in accordance with a second preferred embodiment of the present invention. In the arrangement shown in FIG. 4 the washing and/or filtering apparatus 20 is arranged on its own support structure 22, including but not limited to separate legs or some kind of platform on the bottom floor on which the upflow pulp vessel is standing, at a side of the pulp vessel 10 such that the pulp is discharged from the top of the vessel 10, possibly assisted by a top discharger (not shown), to a downflow vessel or pipe 12, which introduces the pulp to the inlet level of the washing and/or filtering apparatus 20 or slightly thereabove. By the inlet level is understood substantially the horizontal level in which the inlets or inlet ducts to the washing and/or filtering apparatus 20 are located. The gas separator 28 is, in this embodiment of the present invention, arranged separate from the washing and/or filtering apparatus 20, i.e. at a side of the washing and/or filtering apparatus 20 such that the gas separator 28 is structurally supported, for instance by legs 32, on the same support structure 22 as the washing and/or filtering apparatus 20. Another preferred feature of the gas separator 28 is that the separator 28 not only separates gas but also divides the pulp evenly to the inlets 24' and 24" (two inlets shown as an example only) of the washing and/or filtering apparatus 20. Naturally, the gas separator/flow divider 28 may be supported to any other appropriate structure, including, but not limited to the upflow vessel, the downflow vessel and a support structure of its own. A further preferred feature of the gas separator/flow divider 28 is that, in connection with the gas separator/flow divider 28, there is a device or means for controlling the inlet pressure of the washing and/or filtering apparatus 20. Such means may be a constant or fixed throttling or an adjustable valve arranged in the inlet to the gas separator/flow divider 28 or in the outlets thereof, as exemplarily shown in FIGS. 7A and 7B.

Figure 5:
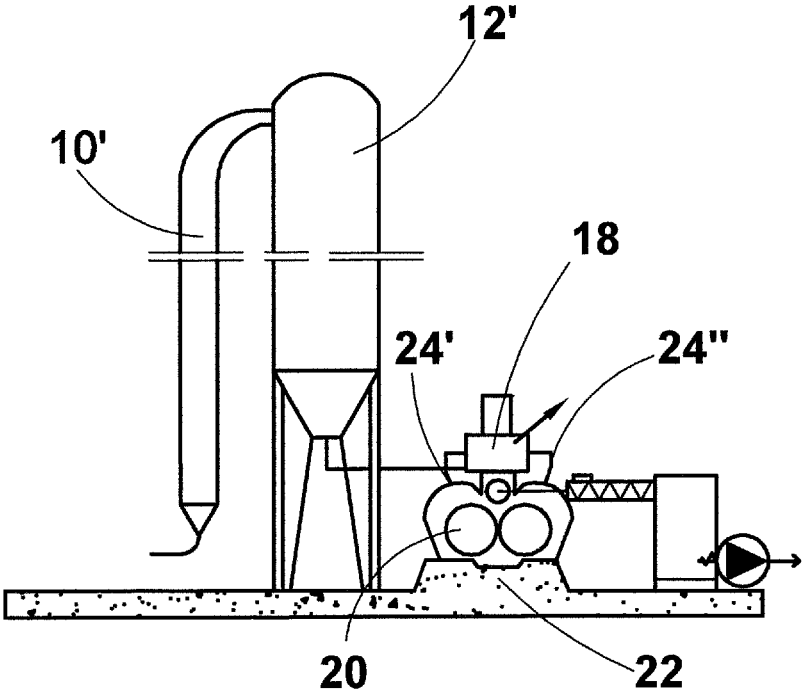
FIG. 5 illustrates a novel arrangement for introducing pulp from a pulp vessel to a washing, filtering and/or thickening apparatus in accordance with a third preferred embodiment of the present invention.

FIG. 5 illustrates an arrangement for introducing pulp from a storage tower or a reactor or some other corresponding upflow pulp vessel to a washing and/or filtering apparatus in accordance with a third preferred embodiment of the present invention. In the arrangement shown in FIG. 5 the vessels preceding the washing and/or filtering apparatus are an upflow pipe 10', which may be just an upflow feed pipe or an upflow pre-reactor arranged to feed the fiber suspension to the downflow vessel 12', i.e. a downflow reactor or a downflow storage tower, and a downflow reactor 12' or downflow storage tower, in general a downflow vessel 12'. The gas separator—washing and/or filtering apparatus unit may be either one of those shown and discussed in FIGS. 2 and 3. Here, the one of FIG. 2 is shown as an example only. Thus, the washing and/or filtering apparatus 20 is arranged on its support structure 22 at a side of the downflow pulp vessel 12' such that the pulp may be discharged at a consistency of at least 5%, normally between 7 and 12%, from the bottom of the downflow vessel 12' to the gas separator 18 arranged to the inlet level of the washing and/or filtering apparatus 20 or slightly thereabove. By the inlet level is understood substantially the horizontal level in which the inlet ducts or inlets 24', 24" to the washing and/or filtering apparatus 20 are located. The washing and/or filtering apparatus 20 includes, in this embodiment of the present invention, a gas separator 18 that is integrated with the washing and/or filtering apparatus 20 such that the gas separator 18 is structurally supported by the washing and/or filtering apparatus 20. Another preferred feature of the separator/flow divider 18 is that it not only separates gas but also divides the pulp evenly to the inlets 24' and 24" (two inlets shown as an example only) of the washing and/or filtering apparatus 20. A further preferred feature of the gas separator/flow divider 18 is that, in connection with the gas separator/flow divider 18, there is a device or means for controlling the inlet pressure of the washing and/or filtering apparatus 20. Such means may be a constant or fixed throttling or an adjustable valve arranged in the inlet to the gas separator/flow divider 18 or in the outlets thereof, as exemplarily shown in FIGS. 7A and 7B.

FIG. 6 illustrates an arrangement for introducing pulp from a storage tower or a reactor or some other corresponding upflow pulp vessel to a washing and/or filtering apparatus in accordance with a fourth preferred embodiment of the present invention. In the arrangement shown in FIG. 6 the vessels preceding the washing and/or filtering apparatus are an upflow pipe 10', which may be just an upflow feed pipe or an upflow pre-reactor arranged to feed the fiber suspension to the downflow vessel 12', i.e. a downflow reactor or a downflow storage tower, and a downflow reactor 12' or downflow storage tower, in general a downflow vessel 12'. The gas separator 18'—washing and/or filtering apparatus 20' unit is now positioned below the downflow reactor or storage tower 12'. Thus, the washing and/or filtering apparatus 20 is arranged on its support structure 22 below the downflow pulp vessel 12' such that the pulp may be discharged from the bottom of the downflow vessel 12' at a consistency of at least 5%, normally between 7 and 12%, directly into the gas separator 18' arranged on top of the washing and/or filtering apparatus 20'. The washing and/or filtering apparatus 20' includes, in this embodiment of the present invention, a gas separator 18' that is integrated with the washing and/or filtering apparatus 20' such that the gas separator 18' is structurally supported by the washing and/or filtering apparatus 20'. Another option would be to support the gas separator 18' from the lower end of the downflow vessel 20'. Another preferred feature of the separator/flow divider 18' is that it not only separates gas but also divides the pulp evenly to the inlets 24' and 24" (two inlets shown as an example only) of the washing and/or filtering apparatus 20'. A further preferred feature of the gas separator/flow divider 18' is that, in connection with the gas separator/flow divider 18', there is a device or means for controlling the inlet pressure of the washing and/or filtering apparatus 20'. Such means may be a constant or fixed throttling or an adjustable valve arranged in the inlet to the gas separator/flow divider 18' or in the outlets thereof, as exemplarily shown in FIGS. 7A and 7B.

In a yet another embodiment of the present invention the gas separator may be arranged in the outlet opening of the downflow reactor or storage tower, i.e. supported by the reactor or tower, and the washing and/or filtering apparatus at a side of the tower. However, also in this embodiment of the present invention it is advantageous that the gas separator functions also as a flow divider.

At this stage it should be understood that the above embodiments are just preferred examples of the present invention and that the present invention may be applied in other types of arrangements, too. Thus, for example, the fiber suspension may also be introduced to the inlet level of the washing and/or filtering apparatus directly or via a pulp transfer line from a preceding process device, like for instance one of another washer, screening and a screw feeder.

An essential feature of the invention is that the pulp need not be pumped up (i.e. the pulp is delivered without pumping) to the washing and/or filtering apparatus 20, 20' from the bottom of the downflow vessel 12. Also it is essential to the invention that the gas separator/flow divider 18, 18' is not located too far above the washing and/or filtering apparatus 20, 20' as the higher the gas separator/flow divider 18. 18' is, the more inlet head (feed pressure) may be lost in the feed piping between the gas separator and the washing and/or filtering apparatus.

FIGS. 7A and 7B show in more detail an exemplary device 18, 18' or 28 that may be used for both separating gas and dividing the pulp flow, i.e. a gas separator/flow divider. FIG. 7A is a schematical axial cross section of the device along line B-B of FIG. 7B, and FIG. 7B is a schematical radial cross section of the device along line A-A of FIG. 7A. The exemplary device comprises a cylindrical housing 34 including one inlet 36 for the pulp at a first end of the housing 34 and, in this case, four outlets 38 at the opposite end of the housing 34. The number of outlets 38 is equal to the number of inlets 24 of the washing and/or filtering apparatus 20 (see FIGS. 3, 4, 5 and 6). The outlets 38 are preferably tangential, though also more or less radial outlets may be used. The housing 34 includes a central shaft 40 with a number of vanes 42 used for rotating the pulp within the housing 34 so that a powerful centrifugal field is created for establishing areas of different pressure conditions (low pressure close to the axis of the device) and therefor gas is separated efficiently to the center of the housing 34. The gas may be removed axially from the rotational center of the housing 34 by means of an outlet 44 arranged centrally to the second end of the housing 34 or via a central hole in the shaft 40. If needed a vacuum pump may be connected to the gas outlet 44.

As to controlling the inlet pressure of the washing and/or filtering apparatus a constant or fixed throttling or an adjustable valve member (shown exemplarily by an X in FIGS. 7A and 7B) may be arranged in the inlet 36, whereby the pressure of the process liquid is reduced before it enters the gas separation. This alternative has the advantage that reducing the pressure of the process liquid facilitates the separation of gas from the process liquid in the gas separator. Another alternative is to control the inlet pressure by adjustable valves or fixed throttlings arranged in the outlets 38. This alternative may not be as advantageous as the first one as now the pressure of the process liquid is not reduced before gas separation.

In view of above it has to be understood that FIGS. 7A and 7B show just an exemplary gas separator/flow divider that may be utilized in practicing the present invention without any intention to limit the invention to that example only. Thereby any apparatus capable of simultaneously both dividing pulp flows and separating gas from pulp may be used in the present invention.

In addition to what is discussed above, gas separation may also be arranged in the inlet chamber of the washing or filtering device, i.e. by providing the cavity of the washing and/or filtering apparatus into which pulp is introduced from the preceding treatment step with a device or means for separating gas and a gas discharge duct. The duct may further including a device or means for drawing gas from the cavity, a vacuum pump, for instance.

The present invention may also be used in a wide variety of applications outside the pulp and paper industry, which is discussed above as an example only. The other applications include, without any limitation, biomass treatment and bio fuel production. In such processes the feedstock need to be pre-treated or hydrolyzed whereby filtering and/or thickening and subsequent pumping are required. Such a feedstock may be for example grass, straw, bagasse, wood, bark, corn stems, etc. It is clear that the invention is not limited to the examples mentioned above but can be implemented in many other different embodiments within the scope of the inventive idea. It is also clear that the features in each embodiment described above may be used in connection with the other embodiments whenever feasible.

The invention claimed is:

1. A method of introducing pulp or fiber suspension of pulp and paper industry from a treatment step to a washing or filtering apparatus having at least one inlet for receiving the pulp or fiber suspension of pulp and paper industry, the method comprising:

discharging pulp or fiber suspension of pulp and paper industry from the treatment step to a gas separator;

separating gas from the pulp or fiber suspension of pulp and paper industry;

introducing the pulp or fiber suspension of pulp and paper industry to the washing or filtering apparatus, performing the separation of gas from the pulp or fiber suspension of pulp and paper industry at a level of the at least one inlet; and controlling the feed pressure of the washing or filtering apparatus by a valve arranged in connection with the gas separator.

2. The method as recited in claim 1, wherein the separation of gas from the pulp or fiber suspension of pulp and paper industry includes dividing the pulp or fiber suspension of pulp and paper industry to a number of partial flows simultaneously with the separation of gas from the pulp or fiber suspension of pulp and paper industry, and the introduction of the pulp or fiber suspension of pulp and paper industry includes introducing each partial flow to a corresponding inlet of the at least one inlet of the washing and/or filtering apparatus.

3. The method as recited in claim 2, wherein the separation of gas from the pulp or fiber suspension of pulp and paper industry includes performing the gas separation and the division of the pulp or fiber suspension of pulp and paper industry flow by a gas separator.

4. The method as recited in claim 1, wherein the treatment step is practiced in one of an upflow vessel, a downflow vessel, a washer, screening and a screw feeder.

5. The method as recited in claim 1, wherein, the discharge of the pulp or fiber suspension of pulp and paper industry includes discharging pulp or fiber suspension from an upflow vessel to a downflow vessel, and providing the gas separator at a lower end of the downflow vessel or in flow communication therewith.

6. The method as recited in claim 1, wherein the valve is one of an adjustable valve and a fixed throttling arranged in communication with the gas separator.

7. The method as recited in claim 1, wherein the pulp or fiber suspension has a consistency, the method further comprising performing the method at a consistency above 5%.

8. The method as recited in claim 1, wherein the pulp or fiber suspension has a consistency, the method further comprising performing the method at a consistency between 7 and 12%.

9. An arrangement for introducing a pulp or fiber suspension of pulp and paper industry from a treatment step to a washing or filtering apparatus, the arrangement including a treatment in which pulp or fiber suspension of pulp and paper industry is discharged to a gas separation and taken therefrom to a washing or filtering apparatus having at least one inlet, the arrangement comprising:

a gas separator configured to perform gas separation, the gas separator being arranged at a level of the at least one inlet and including a valve configured to control a feed pressure of the washing or filtering apparatus.

10. The arrangement as recited in claim 9, wherein the filtering apparatus has a plurality of inlets and the gas separator is configured to divide the pulp to the inlets of the washing or filtering apparatus.

11. The arrangement as recited in claim 9, wherein the arrangement is configured to perform the treatment step in at least one of an upflow vessel and a downflow vessel, the downflow vessel including, at a lower end or in flow communication therewith, the gas separator.

12. The arrangement as recited in claim 11, wherein the gas separator and washing or filter apparatus are arranged below the downflow vessel.

13. The arrangement as recited in claim 9, wherein the treatment step is practiced in one of a washer, screening and a screw feeder arranged in flow communication with the gas separator.

14. The arrangement as recited in claim 9, wherein the gas separator is supported on the washing or filtering apparatus.

15. The arrangement as recited in claim 9, wherein the gas separator is supported at a side of the washing or filtering apparatus on the same support structure with the washing or filtering apparatus.

16. The arrangement as recited in claim 9, wherein the gas separator includes a housing with an inlet, a plurality of outlets for the pulp or fiber suspension of pulp and paper industry, an outlet for gas, a shaft and at least one vane arranged on the shaft.

* * * * *